US005456052A

United States Patent [19]

Anderson et al.

[11] Patent Number: 5,456,052

[45] Date of Patent: Oct. 10, 1995

[54] TWO-PART MASONRY TIE

[75] Inventors: Geoffrey Anderson, North Fitzroy; Roland Maeder, Keilor East, both of Australia

[73] Assignee: Abey Australia Pty. Ltd., Victoria, Australia

[21] Appl. No.: 142,329

[22] PCT Filed: May 27, 1992

[86] PCT No.: PCT/AU92/00239

§ 371 Date: Nov. 26, 1993

§ 102(e) Date: Nov. 26, 1993

[87] PCT Pub. No.: WO92/21831

PCT Pub. Date: Dec. 10, 1992

[30] Foreign Application Priority Data

May 27, 1991 [AU] Australia ..... PK6320

[51] Int. Cl.[6] ..... E04B 2/30

[52] U.S. Cl. ..... 52/713; 52/379; 52/562; 52/565; 52/568; 52/712

[58] Field of Search ..... 52/713, 378, 379, 52/562, 565, 568, 712

[56] References Cited

U.S. PATENT DOCUMENTS

| | | | |
|---|---|---|---|
| 3,277,626 | 10/1966 | Brynjolfsson et al. | 52/713 |
| 3,292,336 | 12/1966 | Brynjolfsson et al. | 52/562 |
| 3,341,998 | 9/1967 | Lucas | 52/713 |
| 4,047,353 | 9/1977 | Aarons | 52/713 |
| 4,722,163 | 2/1988 | Thornton et al. | 52/713 |
| 4,730,422 | 3/1988 | Young | 52/562 |
| 4,765,108 | 8/1988 | Lapish | 52/379 |

*Primary Examiner*—Carl D. Friedman
*Assistant Examiner*—Christopher Todd Kent
*Attorney, Agent, or Firm*—Oblon, Spivak, McClelland, Maier, & Neustadt

[57] ABSTRACT

A masonry brick tie is disclosed which includes two discrete members (1) and (10), each in use being adapted to be disposed in a mortar course of a brick wall in a cavity brick structure. The members (1) and (10) are releasable interconnectable at the respective free ends thereof, thereby facilitating installation thereof within a cavity brick wall structure and yet in no way affecting the strength or operating effectiveness thereof.

6 Claims, 1 Drawing Sheet

TWO-PART MASONRY TIE

TECHNICAL FIELD

The present invention relates, in general terms, to an improved form of masonry or brick tie. The invention relates more particularly, but not exclusively, to a two-part masonry tie, in other words an arrangement made up of two separate, yet interconnectable members.

BACKGROUND ART

In the past it has been an accepted practice in the construction of so-called cavity brick walls, especially in Australia, to initially construct a first wall (preferably the innermost wall) in its entirety and, subsequent thereto, to construct the second (preferably external) wall or courses of bricks spaced-apart therefrom by the prescribed distance. In overseas countries, as for example the United Kingdom, in contrast to the Australian practice it has generally speaking been the routine to construct both inner and outer walls each on a progressive basis.

Regardless of whether or not the Australian or United Kingdom practice is to be pursued, building regulations require that adjacent, juxtaposed walls be interconnected utilizing components known as masonry or brick ties. The employment of such ties serves to provide increased structural rigidity and lateral stability and to assist in prevention of unwanted collapse of masonry brick walls. Such is especially important in, for example, earthquake-prone areas.

In Australia, with the aforementioned practice of initially constructing a first wall and subsequently building adjacent thereto a second wall, the requirement for the use of masonry ties resulted in the first constructed wall having a number of ties or members, generally of metal, disposed therewithin and protruding therefrom at the prescribed intervals. The aim was then to be able to construct the second or juxtaposed wall such that at least part of said protruding member could be located within the mortar thereof. The ties then serve to "connect" the walls in the desired manner. The very existence of such protruding members has however, been found to give rise to problems in terms of the safety of the bricklayer during the course of construction of the adjacent brick wall (on the other side of the cavity). In a practical sense the bricklayer took the risk of cutting or in some way impaling himself on the protruding portions of the ties while actually constructing the second wall. By virtue of the risk of such cutting or impaling, it had become a common practice for the bricklayer to bend the ties either upwards or downwards subsequent to their disposition in the first-built wall. It was the intention that, during construction of the second brick wall, the ties would be bent back into their initial configuration and appropriately located within mortar courses of the second brick wall whereby to provide the desired interconnection between the adjacent walls. Such a practice of first bending a brick tie and subsequently restoring such a tie to its substantially horizontal configuration in itself involved the expenditure of significant periods of time. Furthermore, investigations carried out on buildings which suffered significant damage during the recent earthquakes in Newcastle have revealed that the sometimes adopted practice of bending brick ties out of the way to avoid damage to the bricklayer gave rise to a more practical problem in that, when the second brick wall was being constructed, the brick ties sometimes were not restored to their substantially horizontal configuration so as to be disposed appropriately within the second brick wall. In effect, therefore, and in contrast to the prescribed building regulations, in some instances no brick ties were either in place or effective. The result was that the damage caused by the earthquakes was much more substantial than would have been the case if the walls had been properly constructed and braced, employing brick ties as prescribed.

DISCLOSURE OF THE INVENTION

The arrangement in accordance with the present invention seeks to overcome the problems and disadvantages associated with the prior art by providing a masonry or brick tie of a two-piece construction. Such an arrangement still including a member having a portion thereof protruding from the first constructed brick wall, but the degree of protrusion is much reduced when compared with the prior art arrangements, and hence the changes of the bricklayer cutting or impaling himself on such protruding portions is greatly reduced.

In accordance with the present invention, therefore, there is provided a masonry or brick tie for use in cavity brick structures, said tie including two discrete members each adapted, in use, to be disposed within a mortar course of a respective brick wall and to extend therebetween, and wherein said members are adapted, in use, to be interconnectable at the respective free or protruding ends thereof.

BRIEF DESCRIPTION OF THE DRAWINGS

In order that the invention may be more clearly understood and put into practical effect there shall now be described in detail a preferred embodiment of a masonry or brick tie in accordance with the invention. The ensuing description is given by way of non-limitative example only and is with reference to the accompanying drawings, wherein.

BEST MODE CARRYING OUT THE INVENTION

Figure 1:
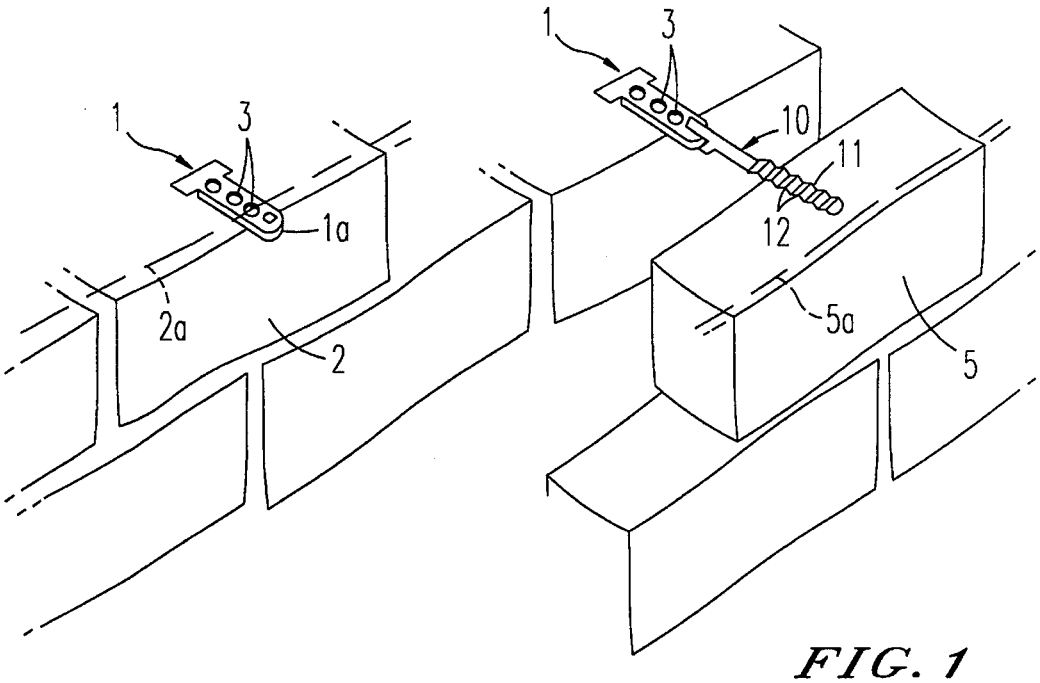
FIG. 1 is a perspective view from above of brick ties in accordance with the present invention when installed within a cavity brick wall, extending between adjacent courses of bricks thereof.
Figure 2:
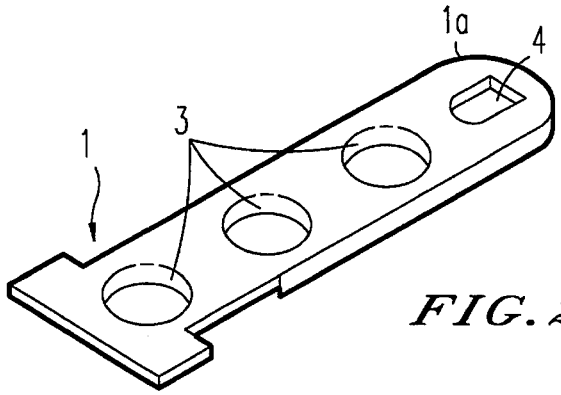
FIG. 2 is a top perspective view of a first component of the two component brick tie in accordance with the present invention.
Figure 3:
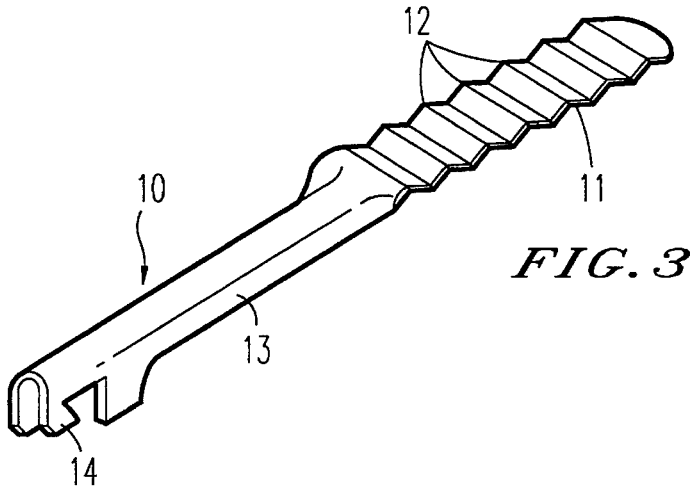
FIG. 3 is a top perspective view of the second component of a two component brick tie in accordance with the invention.

As shown in, for example, FIG. 1, a first member 1 of a brick tie in accordance with the present invention is adapted, in use, to be disposed within a mortar course **2*a* of a first brick wall 2. The first member 1 of the arrangement in accordance with the present invention, of a substantially elongate shape, includes a plurality of substantially circular apertures 3 disposed at spaced-apart intervals along the length thereof. In the preferred embodiment illustrated three such apertures 3 are included. It should be realized, however, that both the overall length of the member 1, and/or the number of apertures 3, may be varied as desired. Such apertures 3 are adapted, in use, to allow for passage therethrough and location therewithin of mortar or the like, whereby to assist in securing or "keeping" the overall member 1 within the mortar course 2*a* itself. In the arrangement as illustrated, again with reference to FIGS. 1 and 2, the first member 1 includes an end portion 1***a*, preferably of a substantially semi-circular shape, having a shaped aperture 4 disposed therethrough. The end portion 1*a* is constructed so as to be substantially smooth-edged, rather than sharp-edged, whereby to minimize the potential cutting effect thereof. Such end portion 1*a* is adapted, in use, to protrude slightly from the wall 2, as shown in FIG. 1.

The second member 10 of the two-part brick tie in accordance with the present invention is also of a substantially elongate shape, being constructed from substantially planar plate material, preferably a metallic material, in any known manner. At one end of the second member 10 there is provided a portion 11 having a plurality of surface projections or corrugations 12 formed thereon, in any known manner, whereby to assist in "keying" of the member 10 itself into the mortar course 5*a* of the relevant wall 5.

The remaining portion 13 of the second member 10 is of substantially arcuate shape when viewed in cross-section, as illustrated for example in FIG. 1. Such arcuate shaping allows any moisture which might condense thereon within the cavity of the cavity-brick wall to fall or drop therefrom, thereby minimizing the potentially destructive effects of rusting and the like on the brick tie itself.

At the free end of the arcuate portion 13 of the second member 10 there is provided a shaped slot 14 which is adapted, in use, to allow for disposition of the second member 10 relative to the first member 1 in the manner as shown in FIG. 1. The slot 14 serves to define or limit the degree of travel available to the second member 10 within and relative to the first member 1, yet at the same time allows for movement to compensate for any shifting of the respective walls 2, 5 which might take place due to earthquakes, the onset of dry weather, shifting of ground, etc.

The arrangement in accordance with the present invention is such that, in the instance of a first wall 2 being constructed, the first members 1 to be associated therewith only marginally or slightly protrude therefrom, thereby minimizing the possibility of the worker being cut by or impaled upon the protruding portion, this in marked contrast to the prior art. When it becomes time for the second or adjacent wall 5 to be constructed the bricklayer can, as required, simply connect the members 1 and 10 and then dispose the respective second members 10 relative to the first members 1 within the mortar course 5*a* of the second wall 5. The arrangement allows for pivotal vertical movement to compensate for variations between levels of bricks when under construction and at the same time allows a certain degree of "play", which could have a significant effect in an earthquake situation. The present arrangement also allows for a certain degree of sideways movement, to take into account "growth" or "shrinkage" of bricks, concrete, mortar or the like.

The present arrangement affords appropriate strength and still ascribes flexibility, yet at the same time is safer for the installer (the bricklayer).

It must be realized that the aforegoing description refers merely to preferred embodiments of the arrangement in accordance with the invention and that variations and modifications will be possible thereto without departing from the spirit and scope of the invention, the extent of which is to be determined from the following claims.

What is claimed is:

1. A masonry or brick tie for use in cavity brick structures, adapted in use to extend between and interconnect first and second brick walls of said cavity brick structure, said tie including:

a first member adapted to be positioned within a mortar course of said first brick wall and which protrudes substantially perpendicularly therefrom, said first member being of a substantially elongate shape and including, at or in the vicinity of one of a free end and a protruding end thereof, an aperture extending therethrough;

said first member having at least one further aperture assisting in retention of said first member within the mortar of said mortar course; and a second member adapted to be positioned within the mortar course of said second brick wall and so as protrude substantially perpendicularly therefrom, said second member being of a substantially elongate shape and having a free end portion for being positioned within said mortar course and which is of a substantially planar shape in cross-section, said second member including one of a plurality of surface projections and corrugations wherein a remainder of said second member is of a substantially arcuate shape in cross-section, and wherein said arcuate remainder of said second member includes, at or in the vicinity of one of a free end and a protruding end thereof, a cut-out portion at each side thereof so as to form one of a hook-like and a hook-shaped end portion which is positioned within said aperture of said first member so as to interconnect said protruding ends of said first and second members.

2. The masonry or brick tie as claimed in claim 1, wherein said at least one further aperture of said at least one first member includes a plurality of apertures disposed along the length of said at least one first member.

3. The masonry or brick tie as claimed in claim 2, wherein all free edges of said at least one first and second members are rounded.

4. The masonry or brick tie as claimed in claim 3, wherein said members each comprise a metallic material.

5. The masonry or brick tie as claimed in claim 3, wherein said members each comprise a plastics material.

6. A method of constructing a cavity brick structure, said brick structure having a first brick wall connected with a second brick wall by at least one masonry or brick tie, which comprises:

providing at least one first member positioned within a mortar course of said first brick wall so as to protrude substantially perpendicularly therefrom, said at least one first member being of a substantial elongate shape and including, at or in the vicinity of one of a free end and a protruding end thereof, an aperture expending therethrough, said at least one first member having at least one further aperture assisting in retention of said at least one first member within the mortar of said mortar course;

providing at least one second member positioned within the mortar course of said second brick wall so as to protrude substantially perpendicularly therefrom, said at least one second member being of a substantially elongate shape and having a free end portion positioned within said mortar course and which is of a substantially planar shape in cross-section, said at least one second member including one of a plurality of surface projections and corrugations wherein a remainder of said at least one second member is of a substantially arcuate shape in cross-section, and wherein said arcuate remainder of said at least one second member includes, at or in the vicinity of one of a free end and a protruding end thereof, a cut-out portion at each side thereof so as to form one of a hook-like and a hook-shaped end portion which is positioned within said aperture of said at least one first member so as to interconnect said protruding ends of said at least one first and second members;

disposing a plurality of said at least one first member within the mortar courses of the first wall;

respectively attaching the end portion of said at least one second member within said aperture of said at least one first member, and disposing said free end of said at least one second member within the mortar course of the second brick wall.

* * * * *